US006098225A

United States Patent [19]

McIntosh et al.

[11] Patent Number: 6,098,225

[45] Date of Patent: *Aug. 8, 2000

[54] FOLDING HAND SHEARS

[75] Inventors: Herman J. McIntosh; Ken E. Griffey; Greg Cook; Larry Hinchman, all of Jacksonville, Ala.

[73] Assignee: Bear MGC Cutlery Co., Inc., Jacksonville, Ala.

[ * ] Notice: This patent is subject to a terminal disclaimer.

[21] Appl. No.: 09/098,676

[22] Filed: Jun. 17, 1998

Related U.S. Application Data

[63] Continuation-in-part of application No. 08/784,941, Jan. 16, 1997, which is a continuation-in-part of application No. 08/609,975, Feb. 29, 1996, Pat. No. 5,697,114.

[51] Int. Cl.[7] ..... B26B 11/00

[52] U.S. Cl. ..... 7/158; 7/128; 30/146

[58] Field of Search ..... 30/123, 131, 134, 30/135, 146; 7/113, 118, 125–131, 158

[56] References Cited

U.S. PATENT DOCUMENTS

| | | | |
|---|---|---|---|
| 154,750 | 9/1874 | Flack | 30/146 |
| 310,439 | 1/1885 | Kamak | 30/146 |
| 318,699 | 5/1885 | Clauberg et al. | 30/146 |
| 858,003 | 6/1907 | Klever | 30/146 |
| 1,524,694 | 2/1925 | Di Maio | 30/146 |
| 1,561,993 | 11/1925 | Nielsen | 7/118 |
| 5,203,084 | 4/1993 | Kuo | 30/135 |
| 5,267,366 | 12/1993 | Frazer | 7/128 |
| 5,689,886 | 11/1997 | Yeh | 30/162 |
| 5,697,114 | 12/1997 | McIntosh et al. | 7/129 |
| 5,743,582 | 4/1998 | Rivera | 294/99.2 |
| 5,781,950 | 7/1998 | Swinden et al. | 7/128 |

*Primary Examiner*—James G. Smith
*Assistant Examiner*—David B. Thomas
*Attorney, Agent, or Firm*—Gardner & Groff, P.C.

[57] ABSTRACT

A pair of folding hand shears comprising first and second generally channel-shaped handles each having first and second ends, each generally channel-shaped handle having an open side and an at least partly closed side opposite the open side, the at least partly closed sides comprising shear-receiving openings. The folding hand shears also include first and second shear halves pivotally mounted to each other, with the shear halves being pivotally mounted between flanges at the first ends of the handles. Control straps extend between the flanges for limiting the maximum pivotal movement of the shear halves and for frictionally resisting pivotal movement of the shear halves. The folding hand shears are foldable between a closed, compact configuration and an opened, extended configuration for cutting with the shears and in the opened, extended configuration the open sides of the handles face each other. A plurality of additional tools are pivotally mounted to the handles.

16 Claims, 5 Drawing Sheets

FOLDING HAND SHEARS

CROSS-REFERENCE TO RELATED APPLICATIONS

This is a continuation-in-part of application Ser. No. 08/784,941 filed on Jan. 16, 1997, now allowed which in turn is a continuation-in-part of application Ser. No. 08/609,975 filed Feb. 29, 1996, now issued as U.S. Pat. No. 5,697,114.

TECHNICAL FIELD

The present invention relates generally to a folding multi-function pocket gardening tool which includes shears and other selected tools.

BACKGROUND OF THE INVENTION

In the field of gardening, two types of hand shears are common. One such type of hand shears is the "anvil-style" shears in which a sharp, narrow cutting blade is moved against a flat-faced jaw (the anvil) to cut through branches, twigs, stems, etc. In the other such type of hand shears, two blades are moved past each other, like in a pair of scissors, to cut items. Each of these types of hand shears arc operated with one hand (as compared to hedge shears or lopping shears which are each operated with two hands). These types of hand shears can be cumbersome to store in one's pocket or elsewhere on one's person due to their overall length and the relatively sharp tips of the cutting blade(s). Also, while such shears are rather effective for such cutting by shearing action, in many situations it would be desirable to have another tool handy.

Outside of the field of gardening, multi-function tools are well known. In typical multi-function tools, pliers and other selected tools, such as screwdrivers, knife blades, files, etc., are provided in a single tool. Known multi-function tools often include pliers and have channel-shaped handles pivotally connected to the tangs of the pliers. The handles fold over so that the pliers are received in the channel-shaped handles. Also, the other tools fold over and are received in the channel-shaped handles as well.

One disadvantage of such known multi-function tool arrangements is that when using the pliers of the tool, the open sides of the channel-shaped handles face outwardly, away from one another. When gripping the tool tightly to secure an object with the plier jaws, the open sides of the channel-shaped handles can become uncomfortable and can limit the amount of gripping force comfortably applied by the user. This problem would become particularly troublesome if one would replace the pliers with shears (it often requires substantial force to cut branches with shears).

U.S. Pat. No. 4,744,272 of Leatherman relates to a foldable tool and discloses the use of handle extensions which can be folded over to provide a broad smooth surface to be grasped and squeezed by the user's hand. This also has the effect of lengthening the tool, thereby making it less compact in operation.

U.S. Pat. No. 5,142,721 of Sessions, et al, relates to a pocket tool with retractable jaws and describes another approach to addressing the need for comfortable plier handles. The pocket tool disclosed in Sessions, et al. includes a pair of retractable jaws which slide into and out of the channel-shaped handles. This tends to add to the complexity of the tool and somewhat reduces the strength of the pliers.

Another disadvantage of such known folding multi-function tool arrangements is that to deploy an individual tool for use, the multi-function tool handles must be opened, the individual tool selected and opened, and the multi-function tool handles closed. This is somewhat cumbersome and slow.

Accordingly, it can be seen that a need remains in the art for folding hand shears which, when the shears are in use, provide a smooth comfortable handgrip. A need also remains for folding hand shears with additional individual tools in which the individual tools can be easily and quickly deployed for use. It is to the provision of such folding hand shears that the present invention is primarily directed.

SUMMARY OF THE INVENTION

Briefly described, in a first preferred form the present invention comprises folding hand shears with first and second generally channel-shaped handles. The handles each have first and second ends and an open side and an at least partly closed side opposite the open side. The at least partly closed sides include openings for receiving shear halves. The folding hand shears also include first and second shear halves pivotally mounted to each other, with the shear halves also being pivotally mounted to the first ends of the handles. Also, the folding hand shears are foldable between a closed, compact configuration and an opened, extended configuration for operating the shears. In the opened, extended configuration, the open sides of the handles face each other.

Preferably, the folding hand shears include, in each of the handles, at least one tool pivotally mounted to the second ends for pivotal movement between a closed position and an opened position, with the tools being received in the open sides of the handles. Preferably, the individual tools can be moved from the closed positions to the opened positions while the folding hand shears are in their closed, compact configuration. Also preferably, the partly closed sides of the folding hand shears are provided with rounded edges for greater comfort.

Preferably, the folding hand shears include first and second control straps for limiting the maximum pivotal movement of the shear halves relative to the handles and for frictionally resisting pivotal movement of the shears. Preferably, the shear halves each include an eccentric tang and the tangs are mounted between flanges. The eccentric tangs engage the control straps and provide greater frictional resistance to pivotal movement of the shears with the hand shears in the opened, extended configuration than in the closed, compact configuration. This allows the hand shears to be easily opened, while at the same time helps to maintain the hand shears in the opened, extended configuration once opened.

In a second preferred form the present invention comprises a pair of folding hand shears with first and second generally channel-shaped handles. The handles each have first and second ends and an open side and an at least partly closed side opposite the open side. The at least partly closed sides include openings for receiving shear halves. The folding hand shears also include first and second shear halves pivotally mounted to each other. The shear halves also are pivotally mounted to the first ends of the handles. Also, the folding hand shears are foldable between a closed, compact configuration and an opened, extended configuration for cutting. In the opened, extended configuration, the open sides of the handles face each other.

The folding hand shears according to the invention are very comfortable to use, are extremely compact, are simple in their construction, and durable in use. The folding hand shears according to the invention also are in widely adaptable, strong, stable and comfortably gripped, allowing the user to apply great force thereto. Conveniently, the invention also allows the individual tools (other than the shears) to be used from the closed, compact configuration without opening the entire folding hand shears.

Accordingly, it is an object of the present invention to provide folding hand shears with comfortable hand grips.

It is another object of the present invention to provide folding hand shears which allow great gripping force to be applied comfortably to the handles of the shears.

It is another object of the present invention to provide a pair of folding hand shears which are relatively compact when the shears are in use.

It is another object of the present invention to provide a pair of folding hand shears which are strong and stable.

It is another object of the present invention to provide a pair of folding hand shears with a plurality of individual tools which can be deployed without opening the entire hand shears.

It is another object of the present invention to provide folding hand shears with a plurality of individual tools which can be easily and quickly deployed.

These and other objects, advantages, and features of the present invention will become apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
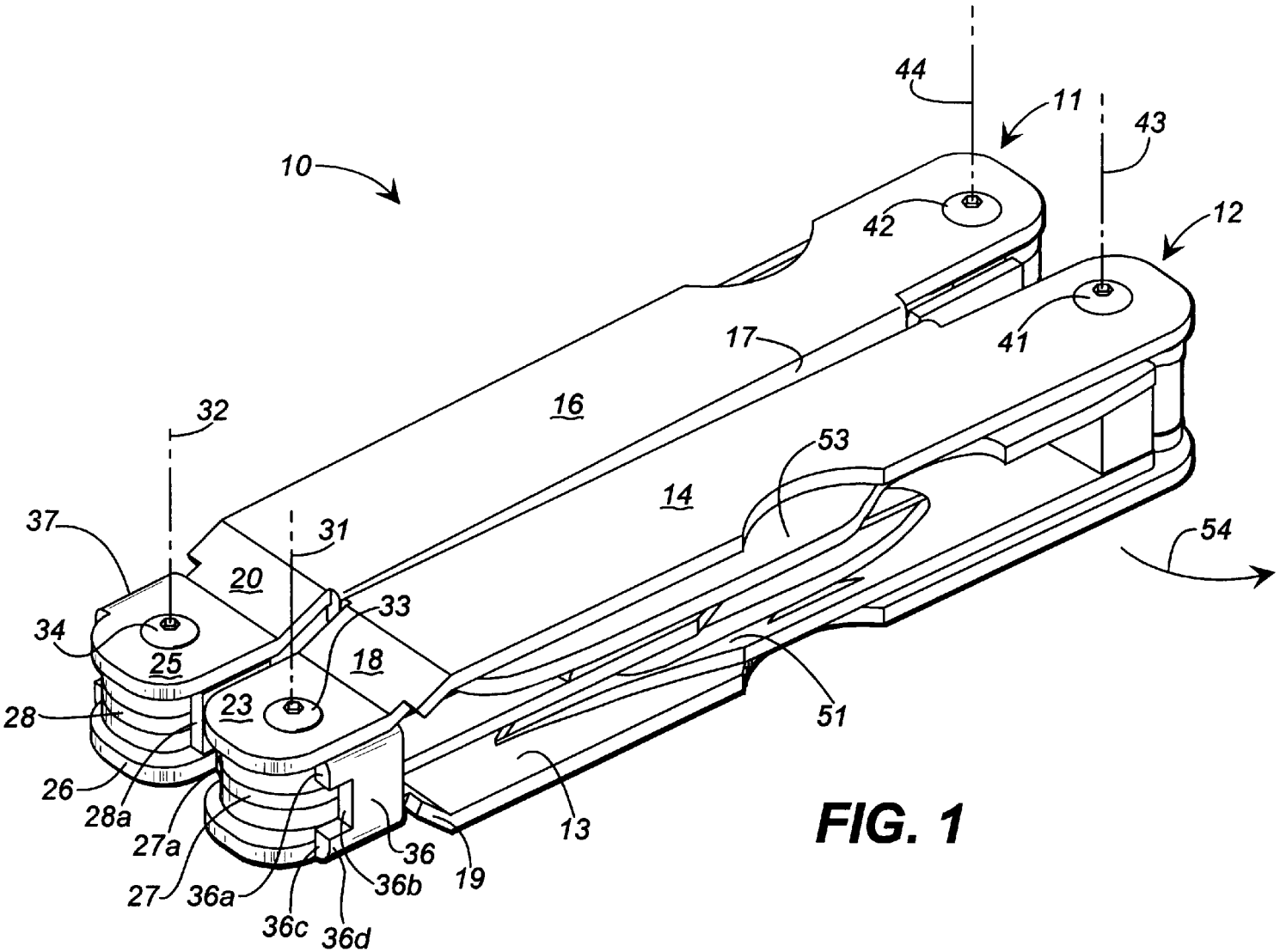
FIG. 1 is a perspective illustration of a pair of folding hand shears in a first preferred form of the invention, shown in a closed, compact configuration.

Referring now to the drawing figures, wherein like reference numerals represent like parts throughout the several views, FIG. 1 shows a pair of folding hand shears 10 according to a preferred form of the invention. The folding hand shears 10 depicted in FIG. 1 are shown in a closed, compact configuration, such as would be used for storing the tool in a sheath. The folding hand shears 10 include first and second channel-shaped handles 11 and 12.

Each of the channel-shaped handles 11 and 12 is generally "C"-shaped in cross-section and includes an upper wall, a lower wall, and a vertically extending wall between the upper and lower walls. For example, handle 12 includes lower wall 13 and upper wall 14 and an unshown (at least in FIG. 1) vertical wall extending therebetween. Likewise, channel-shaped handle 11 includes an upper wall 16, an unshown lower wall, and a vertical wall 17 extending therebetween.

The channel-shaped handles include integral shoulders, such as shoulders 18, 19, and 20. The shoulders extend at an angle between the upper and lower walls of the handles and flange portions, such as flanges 23–26. Shear tangs 27 and 28 are positioned between the flanges 23 and 24, and 25 and 26 (the shears will be described in more detail in connection with subsequent figures). The tangs 27 and 28 are mounted between the flanges for pivotal movement about pivot axes 31 and 32. The tangs 27 and 28 are secured in place by combination bolt/pivot pins 33 and 34 which extend through the upper flanges 23 and 25, through the tangs 27 and 28, and are threadedly received in the lower flanges 24 and 26. The bolts/pivot pins 33 and 34, along with the upper and lower flanges, constrain the movement of tangs 27 and 28 to pivotal movement about the pivot axes 31 and 32.

Extending between the upper and lower flanges are a pair of tang stops 36 and 37 for limiting the pivotal motion of the tangs. The tang stops 36 and 37 each include three vertical surfaces or shoulders, such as surfaces 36*a*, 36*b*, and 36*c*. The tang stops are generally "C" shaped and include upper and lower flanges, such as lower flange 36*d*. The tangs 27 and 28 include tabs 27*a* and 28*a* which engage the tang stops 36 and 37, fitting between the upper and lower flanges of the tang stops and being limited in travel by the shoulders, such as shoulder 36*b*.

Figure 4A:
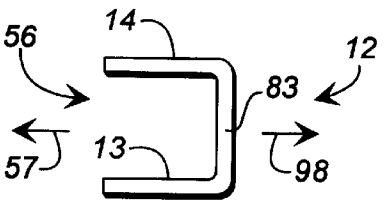
FIG. 4A is a sectional view of the folding hand shears of FIG. 4 taken along the lines of 4A—4A, with some elements omitted for clarity.
Figure 4:
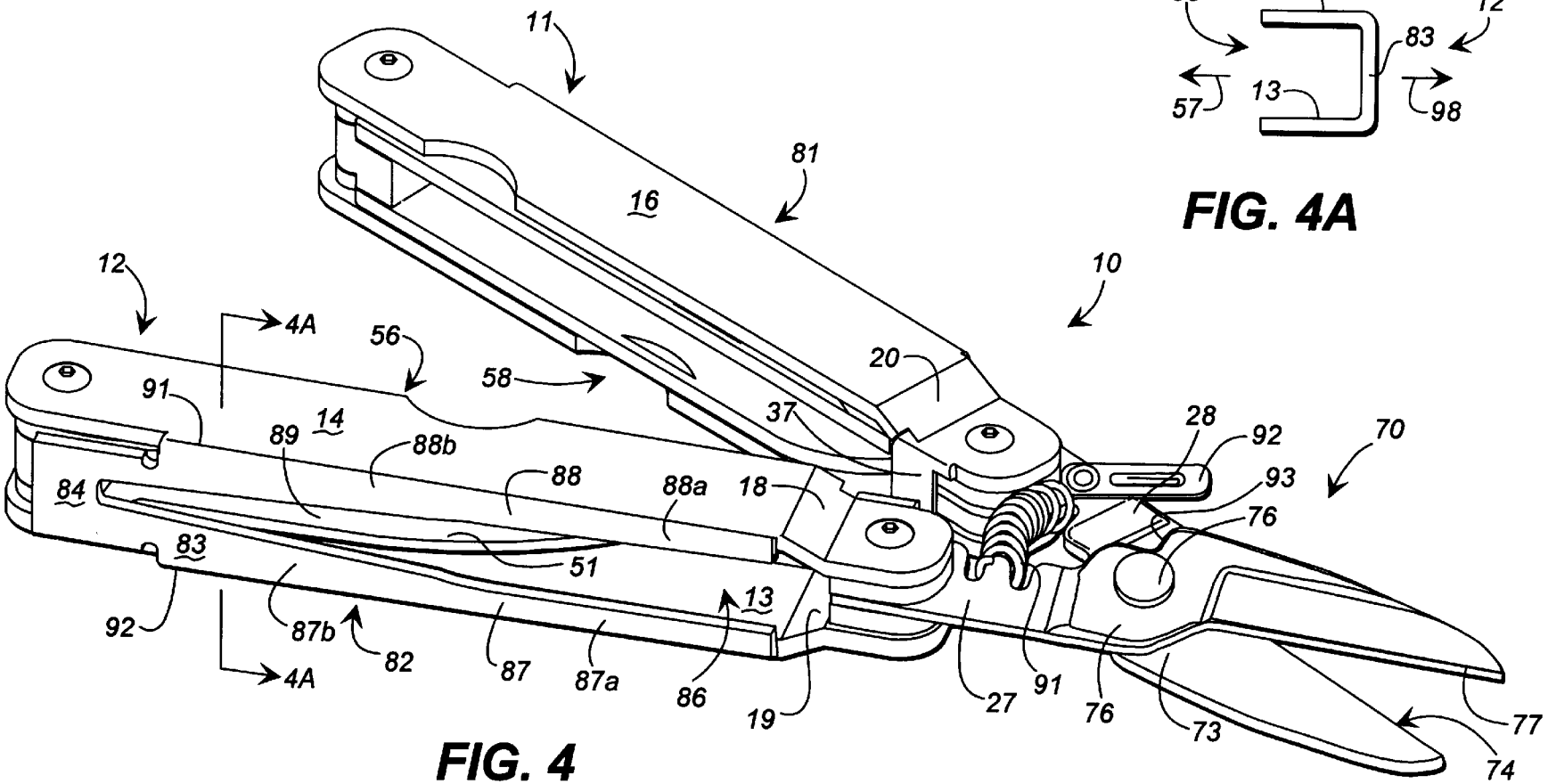
FIG. 4 is a perspective illustration of the folding hand shears of FIG. 1, shown in a fully opened, extended configuration for cutting.
Figure 5:
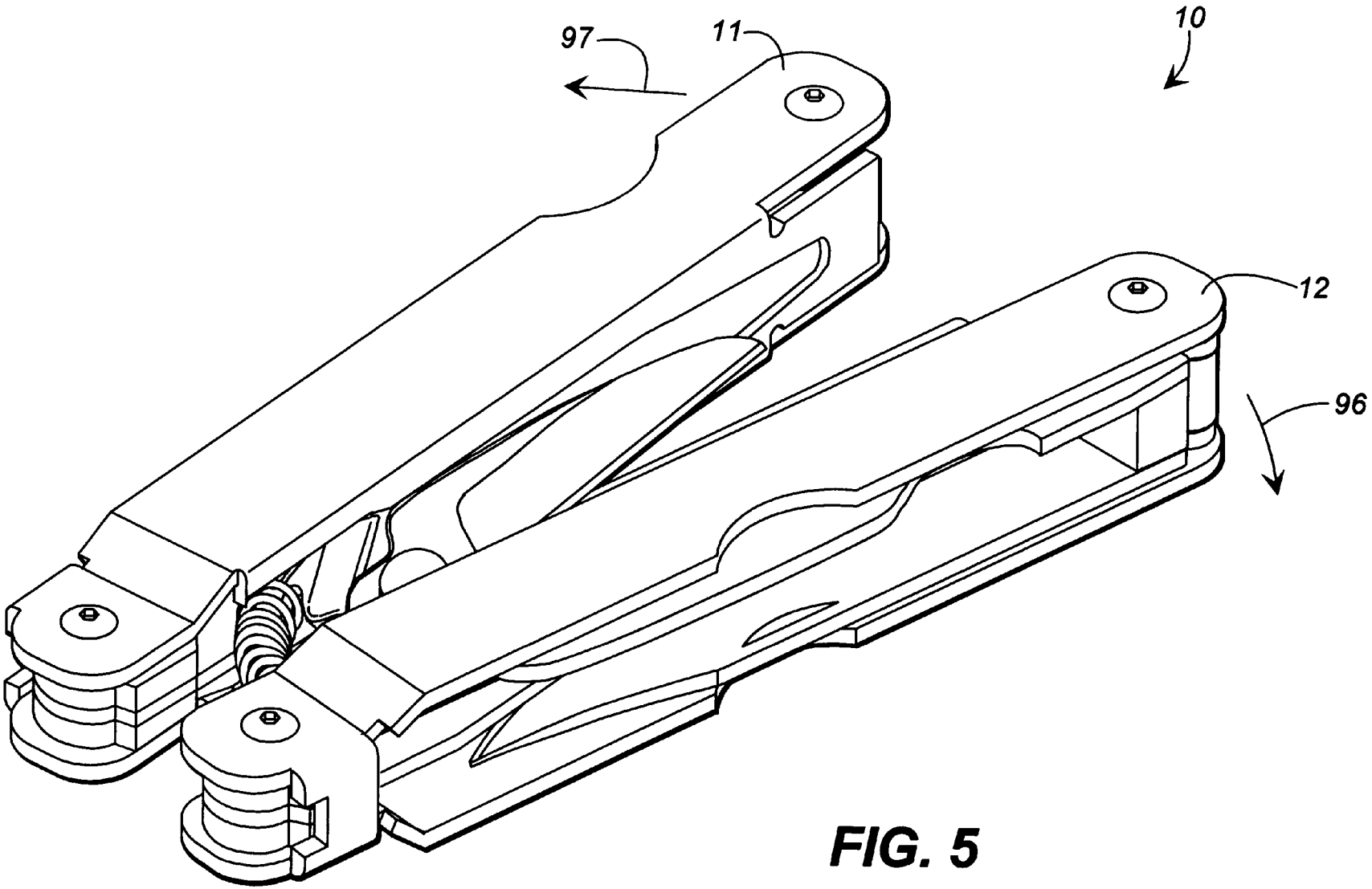
FIG. 5 is a perspective illustration of the folding hand shears of FIG. 1, shown in a slightly opened configuration.
Figures 6, 7:
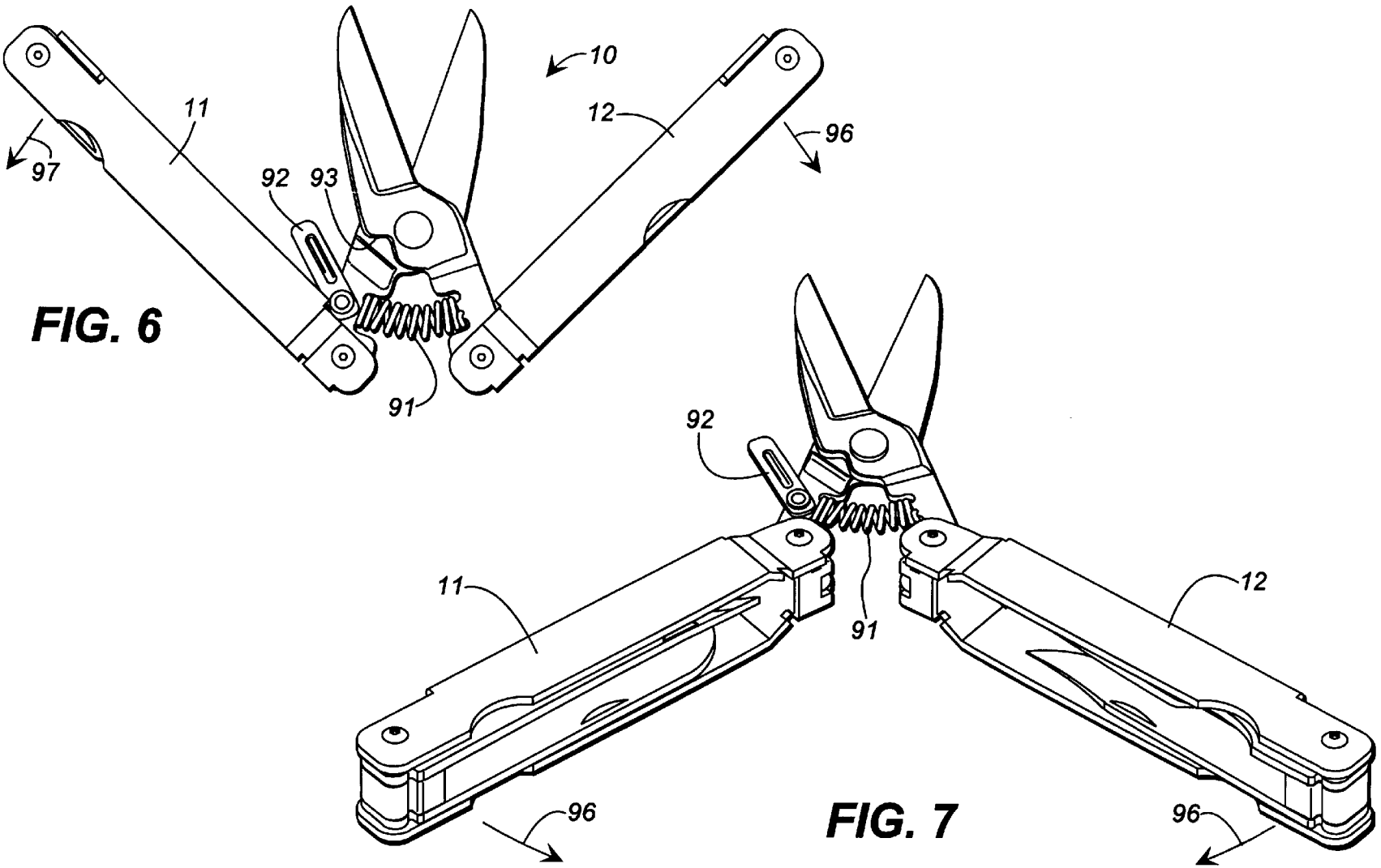
FIG. 6 is a perspective illustration of the folding hand shears of FIG. 1, shown in a moderately opened configuration.
FIG. 7 is perspective illustration of the folding hand shears of FIG. 1, shown in a substantially opened configuration.

The tangs 27, 28 are eccentric and eccentrically contact an interior surface of the tang stops 36, 37 such that when the folding hand shears 10 are in the folded, compact configuration shown in FIG. 1, the tang stops provide a modest frictional resistance to the pivotal movement of the tangs 27, 28, while in the unfolded, opened configuration shown in FIG. 4, the tang stops provide a greater frictional resistance to pivotal movement of the tangs. This allows the folding hand shears to be opened easily and quickly, while also helping to hold the shears in place when the folding hand shears are in the extended configuration of FIG. 4 (making the shears easier to use).

At the end of the handles 11 and 12 opposite the location of the tangs 26 and 27 a second pair of combination bolts/pivot pins is provided, in particular bolts/pivot pins 41 and 42. These bolts/pivot pins extend through the upper walls 14 and 16 of the handles and through numerous individual tools received in the channel-shaped handles, to the lower walls of the handles. Thus, the bolts/pivot pins 41 and 42 act as pivot axles to constrain movement of the various tools to pivotal motion about pivot axes 43 and 44.

A number of tools are pivotally received in the open sides of the handles 11 and 12 and are pivoted about the pivot axes 43 and 44. For example, in the illustrative embodiment shown in FIGS. 1–7, handle 12 includes a knife 51 and saw 53, while handle 11 includes a serrated knife 52 and a weeding tool 55. As can be seen in FIG. 1, these tools are received in the open side of the channel-shaped handles and open outwardly therefrom. For example, the knife 51 or saw 53 can be deployed by rotating each in the direction of direction arrow 54 to swing them outwardly from the open side of the channel-shaped handle 12. This arrangement advantageously allows the tools to be deployed from the closed, compact configuration of the folding hand shears overall, a significant convenience. The present invention allows the user to select, deploy and use an individual tool without opening up the folding hand shears overall.

Figures 2, 3:
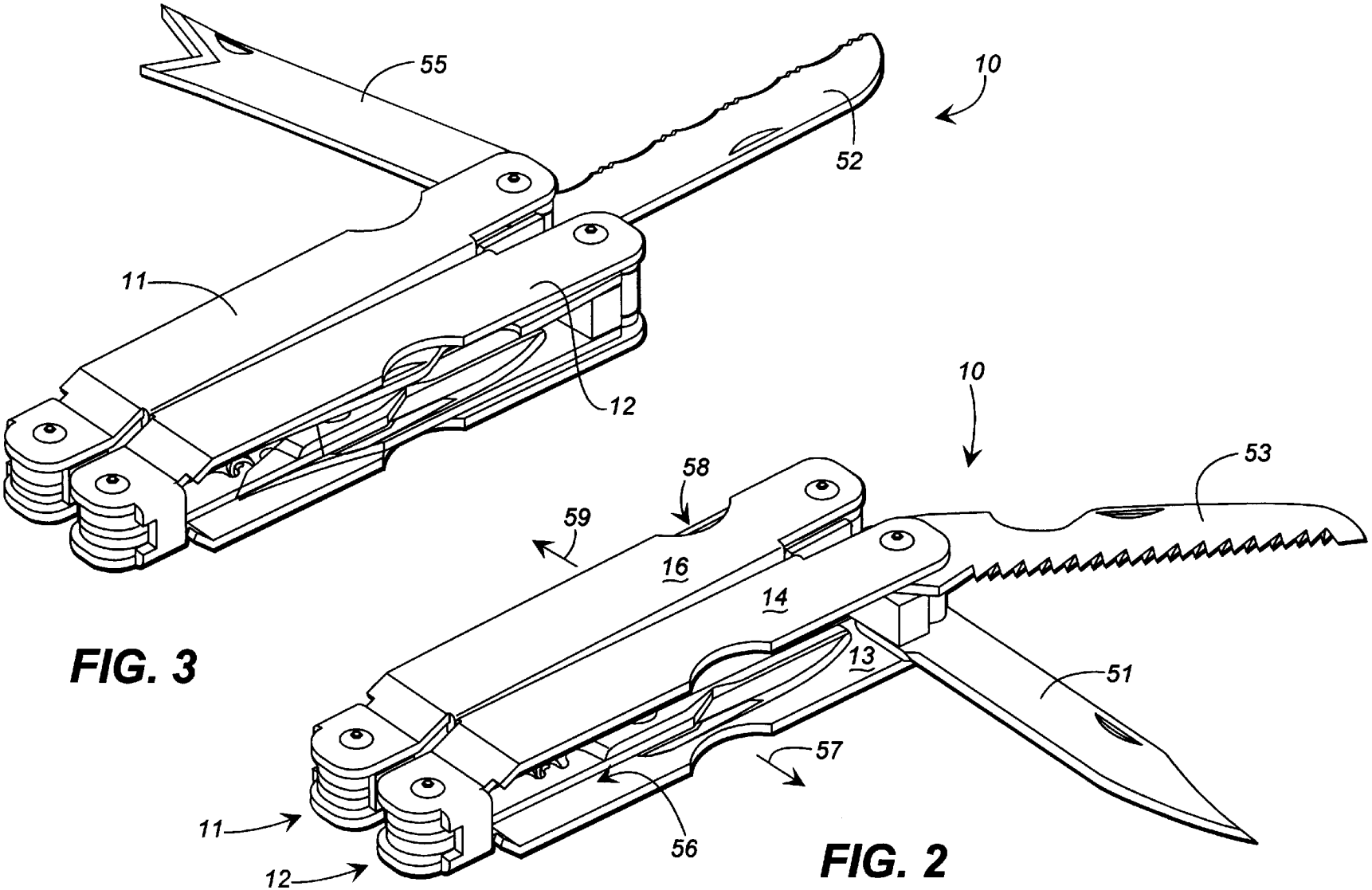
FIG. 2 is a perspective illustration of the folding hand shears of FIG. 1, shown with some tools thereof deployed.
FIG. 3 is a perspective illustration of the folding hand shears of FIG. 1, shown with some other tools thereof deployed.

FIGS. 2 and 3 show how the individual tools can be easily and quickly deployed without opening up the entire folding hand shears. For example, in FIG. 2 the folding hand shears 10 are shown in a closed, compact configuration with the open sides of the channel-shaped handles 11 and 12 facing away from each other. For example, as shown in FIG. 2, the channel-shaped handle 12 has an open side 56 which generally points in the direction of direction arrow 57. Likewise, channel-shaped handle 11 has an open side 58 which points in the direction of direction arrows 59, which is opposite to direction arrow 57. With this construction, the individual tools, such as knife 5 1, the serrated knife 52, and the saw 53, and the weeding tool 55 can be quickly and easily deployed, without opening up the entire folding hand shears 10.

Referring now to FIG. 4, the folding hand shears 10 are shown in the open, extended configuration for using the shears. The folding hand shears 10 include A shears couplet 70 having a first shear half 71 and a second shear half 72. First shear half 71 includes tang 28, a lower platen 73 and cutting edge 74. Similarly, second shear half 72 includes tang 27, upper platen 76, and cutting edge 77. A large pivot pin 78 extends through the upper and lower platens and secures them to one another and acts as a pivot axle to allow the first and second shear halves 71 and 72 to be pivoted relative to each other. As can be seen in this figure, the tang stops, such as tang stop 37, limit the pivotal movement of the tangs 27 and 28 to allow the handles 11 and 12 to operate the shears.

As previously described, the handles 11 and 12 include open sides 56 and 58. The handles 11 and 12 also include partly closed sides 81 and 82. Each of the partly closed sides includes a vertical wall, such as vertical wall 83 of handle 12 (shown in FIG. 4) or vertical wall 17 shown in FIG. 1. These vertical walls extend between the upper and lower sides of the handles, such as upper and lower sides 13 and 14 of handle 12. The vertical walls include a tool stop and tool keeper, such as stop and keeper 84 shown in FIG. 4. The tool stop and keeper 84 is not connected to the upper and lower sides 13 and 14, but rather extends from an end of vertical wall 83. Where the tool stop and keeper 84 adjoins to the remainder of the vertical wall 83, radiused corners are cut out in order to avoid stress spikes which would otherwise lead to a fatigue fracture over repeated uses of the tools. This is so because the tools, as they are opened, cause a slight deflection of the tool stop 84. In this way, the tool stop provides a frictional resistance to pivotal movement of the individual tools. Handle 11 includes a similar tool stop.

The vertical wall 83 also includes a shear half opening 86 defined by a lower face strip 87 and an upper face strip 88. The lower face strip 87 includes a straight section 87*a* and a tapered section 87*b*. Likewise, the upper strip 88 includes a straight section 88*a* and a tapered section 88*b*. Together, the straight sections 87*a* and 88*a* define a straight portion of the opening 86, while the tapered portions 87*b* and 88*b* of the strips define a tapered portion of the opening 86. Near the end of the tapered opening, a stop 89 is attached to the pivot axle 42 and limits the travel of the shear half into the opening 86.

At the interface between the upper wall 14 and the vertical wall 83, the edge 91 therebetween is rounded, preferably with a radius of between about 5/64 and 7/64 of an inch, most preferably 3/32 of an inch. Likewise, the lower edge 92 has a similar radius, as do the corresponding edges on handle 11.

FIG. 4A shows a sectional view of shear handle 12 (with the individual tools removed for clarity). The channel-shaped handle 12 has an open side 56 and partly closed side comprising the vertical wall 83 (which includes the unshown opening for receiving the shear half). The individual tools open by moving in the direction of direction arrow 57, while the shears open from the opposite side in the direction of direction arrow 58. Thus, the individual tools and the shears open from opposite sides of the handle 12. Handle 11 is similarly constructed.

To operate the folding hand shears, one starts with the folding hand shears 10 in the configuration shown in FIG. 1 (a closed, compact configuration). The handles are then spread apart, with the shear couplet acting as a pivot point to achieve the slightly opened configuration of FIG. 5. The handles 11 and 12 are moved A in the direction of direction arrows 96 and 97 (away from one another) to obtain the moderately opened configuration of FIG. 6. The handles are moved A in the direction of direction arrows 96 and 97 to achieve the substantially opened, but not quite fully opened, configuration of FIG. 7. The handles are brought even more towards each other in the direction of direction arrows 96 and 97 to achieve the fully opened, extended configuration shown in FIG. 4.

In order to make the folding hand shears more convenient to use, a compression spring 91 is positioned between the tangs to bias them away from each other. In this way the compression spring 91 acts to bias the cutting edges away from each other, thereby readying the folding hand shears for a subsequent cutting operation simply upon the user releasing his/her grip on the handles. The ends of the compression spring 91 are fitted over tabs formed in the tangs, with the tabs substantially facing each other.

To lock the shear couplet 70 in the closed position, a pivotal lock lever 92 is pivoted into engagement with a notch 93. As is well-known in the gardening tool art, this enhances the safety of the shears couplet by effectively keeping the cutting edges of the shears from being exposed when not desired.

This construction has numerous advantages. For example, the individual tools can be deployed without opening the entire folding hand shears. Also, these individual tools can be easily and quickly deployed. Moreover, with the hand shears in the opened, extended configuration shown in FIG. 4, the handles 11 and 12 are quite comfortable owing to the fact that the portions of the handles contacting the user's hands are at least partly closed (rather than the open side containing the individual tools), thereby providing a more even distribution of the gripping force over the user's hand. Also, the use of the rounded edges (e.g., 91, 92) makes for a more comfortable grip as well. This more comfortable grip allows greater gripping force to be applied comfortably to the handles, making the shears more useful as a useful working tool. This construction also allows the folding hand shears to be rather compact when using the shears, while still providing excellent comfort. It also has the advantage that the shears are rather strong and stable, enabling the shears to do substantial work. Another advantage of this construction is that the construction of the hand shears is an elegantly simple solution to the problem of providing comfortable hand grips for the shears, making the folding hand shears durable and easily constructed. Also, the eccentric tangs engaging the tang stops eccentrically allow the hand shears to be easily opened and help to stabilize the shears once in the extended, open configuration.

While the invention has been disclosed in preferred forms, it will be apparent to those skilled in the art that many modifications, additions, and deletions may be made therein without departing from the spirit and scope of the invention as set forth in the following claims.

What is claimed is:

1. Folding hand shears for cutting branches, twigs, stems, and the like and comprising:

first and second generally channel-shaped handles each having first and second ends, each generally channel-shaped handle comprising an open side and an at least partly closed side opposite said open side, said at least partly closed sides each comprising an opening for receiving hand shear halves;

first and second shear halves pivotally mounted to each other, with said shear halves being pivotally mounted to said first ends of said handles; and wherein said folding hand shears are foldable between a closed, compact configuration and an opened, extended configuration for cutting and wherein in said opened, extended configuration said open sides of said handles face each other.

2. Folding hand shears comprising:

first and second generally channel-shaped rigid handles having first and second ends, said handles each having first and second sides opposite each other, and wherein said first sides of said handles each include rounded longitudinal edges;

shear cutting means pivotally mounted to said first ends of said handles, said first and second handles being foldable between a compact configuration and an extended configuration for manipulating said shear cutting means; and a plurality of tools pivotally mounted to said handles, wherein with said folding hand shears in said compact configuration at least some of said plurality of tools can be opened without moving said handles from said compact configuration to said extended configuration, and wherein with said handles in said extended configuration said first sides of said handles having said rounded longitudinal edges face away from each other.

3. Folding hand shears as claimed in claim 2 wherein said second sides of said handles are partly closed and include openings for receiving said shears and wherein said plurality of tools are pivotally mounted to said second ends of said handles.

4. Folding hand shears as claimed in claim 2 wherein said shear cutting means comprises first and second shear halves pivotally mounted to each other and pivotally mounted to said first ends of said handles.

5. The folding hand shears of claim 1 further comprising a compression spring for biasing said first and second shear halves toward an open position.

6. The folding hand shears of claim 1 further comprising a locking member for securing said first and second shear halves in a closed position relative to each other.

7. Folding hand shears comprising:

a first handle having a first end and a second end, said first handle including an at least partly open side defining an opening therethrough;

a second handle having a first end and a second end, said second handle including an at least partly open side defining an opening therethrough;

a first tool pivotally connected to said first handle at said second end of said first handle;

a second tool pivotally connected to said second handle at said second end of said second handle;

a first shear half pivotally connected to said first handle at said first end of said first handle;

a second shear half pivotally connected to said second handle at said first end of said second handle;

a first stop means for limiting movement of said second shear half through said opening of said first handle; and a second stop means for limiting movement of said first shear half through said opening of said second handle.

8. The folding hand shears of claim 7 further comprising a compression spring for biasing said first and second shear halves toward an open position.

9. The folding hand shears of claim 7 further comprising a locking member for securing said first and second shear halves in a closed position relative to each other.

10. The folding hand shears of claim 7 wherein said first and second shear halves each comprise a shear blade.

11. Folding hand shears comprising:

a first handle having a first end and a second end, said first handle comprising a first side;

a second handle having a first end and a second end, said second handle comprising a first side;

first and second shear halves pivotally mounted to each other, with said shear halves being pivotally mounted to said first ends of said handles;

a first tool pivotally mounted to said first handle, said first tool being pivotally moveable between a closed position and an open position;

a second tool pivotally mounted to said second handle, said second tool being pivotally moveable between a closed position and an open position;

wherein said folding hand shears are foldable between a closed, compact configuration and an opened, extended configuration for operating said shears; and wherein with said folding hand shears in said closed, compact configuration, said first sides of said handles face away from each other in opposite directions and said first tool is movable from said closed position to said open position while said folding hand shears remain in said closed, compact configuration.

12. The folding hand shears as claimed in claim 9 wherein said first tool comprises a knife blade.

13. The folding hand shear as claimed in claim 10 wherein said second tool comprises a saw blade and is moveable from said closed position to said open position while said folding hand shears remain in said closed, compact configuration.

14. The folding hand shears of claim 11 further comprising a compression spring for biasing said first and second shear halves toward an open position.

15. The folding hand shears of claim 11 further comprising a locking member for securing said first and second shear halves in a closed position relative to each other.

16. Folding hand shears comprising:

first and second generally channel-shaped handles having first and second ends, said handles each having first and second sides opposite each other;

shear members pivotally mounted to said first ends of said handles; and a plurality of tools pivotally mounted to said handles, and wherein said folding hand shears are foldable between a compact closed configuration and an extended, opened configuration, and wherein with said folding hand shears in said compact, closed configuration said plurality of tools can be opened and closed without moving said folding hand shears to said extended, opened configuration.

* * * * *